US006230621B1

(12) United States Patent
Verschueren et al.

(10) Patent No.: US 6,230,621 B1
(45) Date of Patent: May 15, 2001

(54) PROCESSLESS THERMAL PRINTING PLATE WITH WELL DEFINED NANOSTRUCTURE

(75) Inventors: Eric Verschueren, Merksplas; Ludo Van Rompuy, Mortsel; Joan Vermeersch, Deinze; Luc Leenders, Herentals, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/339,229

(22) Filed: Jun. 24, 1999

Related U.S. Application Data

(60) Provisional application No. 60/101,033, filed on Sep. 18, 1998.

(30) Foreign Application Priority Data

Jul. 31, 1998 (EP) ..... 98202576

(51) Int. Cl.[7] ..... B41N 1/14
(52) U.S. Cl. ..... 101/453; 101/467
(58) Field of Search ..... 101/453, 454, 101/456, 457, 462, 463.1, 465–467; 430/302

(56) References Cited

U.S. PATENT DOCUMENTS 4,687,729 * 8/1987 Cadwell et al. ..... 101/463.1
5,213,920 * 5/1993 Coppens et al. ..... 430/49
5,254,421 * 10/1993 Coppens et al. ..... 101/465
5,405,729 * 4/1995 Coppens et al. ..... 430/204
5,633,110 * 5/1997 Desie et al. ..... 430/120

FOREIGN PATENT DOCUMENTS 0 770 494 5/1997 (EP) .

OTHER PUBLICATIONS

Research Disclosure: "A Lithographic Printing Plate", No. 333, Jan. 1, 1992, p. 2, XP0000281114.

* cited by examiner

*Primary Examiner*—Stephen R. Funk
(74) *Attorney, Agent, or Firm*—Breiner & Breiner

(57) ABSTRACT

According to the present invention there is provided a heat-sensitive material for making lithographic printing plates having on a lithographic support an image-forming layer including a hydrophilic binder, a cross-linking agent for the hydrophilic binder, metal oxide particles with a mean diameter of at least 100 nm and dispersed hydrophobic thermoplastic polymer particles, characterized in that the image-forming layer has a ratio of specific surface (in $m^2$ per g) over mean roughness(in $\mu$m) of more than 0.65 and that the mean pore width is less than 15 nm.

10 Claims, No Drawings

PROCESSLESS THERMAL PRINTING PLATE WITH WELL DEFINED NANOSTRUCTURE

This application is based on provisional application Serial No. 60/101,033 filed Sept. 18, 1998.

FIELD OF THE INVENTION

The present invention relates to a heat-sensitive material for preparing lithographic printing plates.

More specifically the invention is related to a processless heat-sensitive material which yields lithographic printing plates with a high endurance.

BACKGROUND OF THE INVENTION

Lithographic printing is the process of printing from specially prepared surfaces, some areas of which are capable of accepting ink, whereas other areas will not accept ink.

In the art of photolithography, a photographic material is made imagewise receptive to oily or greasy ink in the photo-exposed (negative working) or in the non-exposed areas (positive working) on an ink-repelling background.

In the production of common lithographic plates, also called surface litho plates or planographic printing plates, a support that has affinity to water or obtains such affinity by chemical treatment is coated with a thin layer of a photosensitive composition. Coatings for that purpose include light-sensitive polymer layers containing diazo compounds, dichromate-sensitized hydrophilic colloids and a large variety of synthetic photopolymers. Particularly diazo-sensitized systems are widely used.

Upon imagewise exposure of such light-sensitive layer the exposed image areas become insoluble and the unexposed areas remain soluble. The plate is then developed with a suitable liquid to remove the diazonium salt or diazo resin in the unexposed areas.

On the other hand, methods are known for making printing plates involving the use of imaging elements that are heat-sensitive rather than photosensitive. A particular disadvantage of photosensitive imaging elements such as described above for making a printing plate is that they have to be shielded from daylight. Furthermore they have a problem of unstable sensitivity with regard to the storage time and they show a lower resolution. The trend towards heat-sensitive printing plate precursors is clearly seen on the market.

For example, Research Disclosure no. 33303 of January 1992 discloses a heat-sensitive imaging element comprising on a support a cross-linked hydrophilic layer containing thermoplastic polymer particles and an infrared absorbing pigment such as e.g. carbon black. By image-wise exposure to an infrared laser, the thermoplastic polymer particles are image-wise coagulated thereby rendering the surface of the imaging element at these areas ink accepting without any further development. A disadvantage of this method is that the printing plate obtained is easily damaged since the non-printing areas may become ink-accepting when some pressure is applied thereto. Moreover, under critical conditions, the lithographic performance of such a printing plate may be poor and accordingly such printing plate has little lithographic printing latitude.

Furthermore EP-A-770 494, 770 495, 770 496 and 770 497 disclose a method for making a lithographic printing plate comprising the steps of (1) image-wise exposing to light a heat-sensitive imaging element comprising (i) on a hydrophilic surface of a lithographic base an image-forming layer comprising hydrophobic thermoplastic polymer particles dispersed in a hydrophilic binder and (ii) a compound capable of converting light to heat, said compound being comprised in said image-forming layer or a layer adjacent thereto; (2) and developing a thus obtained image-wise exposed element by rinsing it with plain water.

The above mentioned heat-sensitive imaging elements for making lithographic printing plates are not optimal regarding staining and scratch resistance.

OBJECTS OF THE INVENTION

It is an object of the present invention to provide a processless heat-sensitive imaging material for making lithographic printing plates having excellent printing properties.

It is a further object of the invention to provide a heat sensitive imaging material for making lithographic printing plates with an improved scratch resistance.

Further objects of the present invention will become clear from the description hereinafter.

SUMMARY OF THE INVENTION

According to the present invention there is provided a heat-sensitive material for making lithographic printing plates comprising on a lithographic support an image-forming layer comprising a hydrophilic binder, a cross-linking agent for said hydrophilic binder, metal oxide particles with a mean diameter of at least 100 nm and dispersed hydrophobic thermoplastic polymer particles, characterized in that said image-forming layer has a ratio of specific surface (in $m^2$ per g) over mean roughness(in $\mu$m) of more than 0.75 and that the mean pore width is less than 15 nm.

DETAILED DESCRIPTION OF THE INVENTION

The specific surface of the coating (in $m^2$ per g) is measured by a Micromeritics ASAP2400-apparatus. Therefore the material, including the support, is cut in small pieces and introduced into the apparatus, then a sorption/desorption isotherm of the material is measured with nitrogen-gas as adsorbate.

From the obtained sorption/desorption isotherms, the specific surface is calculated, following the sorption/desorption approximation corresponding with BET. Also the mean pore diameter is calculated by the method of Barett, Joyner and Hallender.

The average surface roughness of the plate (in $\mu$m) is measured with a perthometer MAHR PERTHEN S6P containing a measuring head RTK50 (tradename of Feinprüf Perthen GmbH, Goettingen, Germany) equipped with a diamond stylus with a diameter of 50 $\mu$m under a pressure of 1.0 mN according to techniques well known in the art. The sampling length Ls which is the reference length for roughness evaluation measures 0.25 mm. The evaluation length Lm, being that part of the travelling length Lt which is evaluated for acquiring the roughness profile R contains standard 5 consecutive sampling lengths. The traversing length Lt is the overall length travelled by the tracing system when acquiring the roughness profile. The average roughness Ra is the measured roughness averaged over the evaluation length Lm.

Preferably the ratio of specific surface over mean roughness is more than 0.75, more preferably more than 0.85. The mean pore width is preferably less than 10 nm, more preferably less than 7 nm.

According to the present invention to improve sensitivity and throughput and to avoid scumming an imaging element is provided comprising preferably hydrophobic thermoplastic polymer particles with an average particle size between 40 nm and 150 nm. More preferably the hydrophilic thermoplastic polymer particles are used with an average particle size of 40 nm to 80 nm. Furthermore the hydrophobic thermoplastic polymer particles used in connection with the present invention preferably have a coagulation temperature above 50° C and more preferably above 70° C. Coagulation may result from softening or melting of the thermoplastic polymer particles under the influence of heat. There is no specific upper limit to the coagulation temperature of the thermoplastic hydrophobic polymer particles, however the temperature should be sufficiently below the decomposition temperature of the polymer particles. Preferably the coagulation temperature is at least 10° C. below the temperature at which the decomposition of the polymer particles occurs. When said polymer particles are subjected to a temperature above the coagulation temperature they coagulate to form a hydrophobic agglomerate in the hydrophilic layer so that at these parts the hydrophilic layer becomes hydrophobic and oleophilic.

Specific examples of hydrophobic polymer particles for use in connection with the present invention have a Tg above 80° C. Preferably the polymer particles are selected from the group consisting of polyvinyl chloride, polyvinylidene chloride, polyacrylonitrile, polyvinyl carbazole etc., copolymers or mixtures thereof. Most preferably used are polystyrene, polymethylmethacrylate or copolymers thereof.

The weight average molecular weight of the polymers may range from 5,000 to 5,000,000 g/mol.

The polymer particles are present as a dispersion in the aqueous coating liquid of the image-forming layer and may be prepared by the methods disclosed in U.S. Pat. No. 3,476,937. Another method especially suitable for preparing an aqueous dispersion of the thermoplastic polymer particles comprises:

dissolving the hydrophobic thermoplastic polymer in an organic water immiscible solvent, dispersing the thus obtained solution in water or in an aqueous medium and removing the organic solvent by evaporation.

The amount of hydrophobic thermoplastic polymer particles contained in the image-forming layer is preferably at least 10% by weight and more preferably at least 15% by weight and most preferably at least 20% by weight of the total weight of said layer.

Suitable hydrophilic binders for use in an image-forming layer in connection with this invention are water soluble (co)polymers for example synthetic homo- or copolymers such as polyvinylalcohol, a poly(meth)acrylic acid, a poly (meth)acrylamide, a polyhydroxyethyl(meth)acrylate, a polyvinylmethylether or natural binders such as gelatin, a polysaccharide such as e.g. dextran, pullulan, cellulose, arabic gum, alginic acid, inuline or chemically modified inuline.

A cross-linked hydrophilic binder in the heat-sensitive layer used in accordance with the present embodiment also contains substances that increase the mechanical strength and the porosity of the layer e.g. metal oxide particles having an average diameter of at least 100 nm which are particles of titanium dioxide or other metal oxides. Incorporation of these particles gives the surface of the cross-linked hydrophilic layer a uniform rough texture consisting of microscopic hills and valleys. Particularly preferable is titanium dioxide, used in 50 to 95% by weight of the heat-sensitive layer, more preferably in 60 to 90% by weight of the heat-sensitive layer.

The image-forming layer also comprises crosslinking agents. such as formaldehyde, glyoxal, polyisocyanate or a hydrolyzed tetra-alkylorthosilicate. The latter is particularly preferred.

The imaging element can further include a compound capable of converting light to heat. Suitable compounds capable of converting light into heat are preferably infrared absorbing components although the wavelength of absorption is not of particular importance as long as the absorption of the compound used is in the wavelength range of the light source used for image-wise exposure. Particularly useful compounds are for example dyes and in particular infrared dyes and pigments and in particular infrared pigments such as carbon black, metal carbides, borides, nitrides, carbonitrides, bronze-structured oxides and oxides structurally related to the bronze family but lacking the A component e.g. $WO_{2.9}$. It is also possible to use conductive polymer dispersion such as polypyrrole or polyaniline-based conductive polymer dispersions. The lithographic performance and in particular the print endurance obtained depends inter alia on the heat-sensitivity of the imaging element. In this respect it has been found that carbon black yields very good and favorable results.

A light-to-heat converting compound in connection with the present invention is most preferably added to the image-forming layer but at least part of the light-to-heat converting compound may also be comprised in a neighboring layer.

The imaging layer preferably contains surfactants which can be anionic, cationic, non-ionic or amphoteric. Perfluoro surfactants are preferred. Particularly preferred are non-ionic perfluoro surfactants. Said surfactants can be used alone or preferably in combination.

The weight of the imaging layer ranges preferably from 1 to 12 $g/m^2$, more preferably from 3 to 9 $g/m^2$.

The lithographic base according to the present invention can be aluminum e.g. electrochemically and/or mechanically grained and anodized aluminum.

Furthermore in connection with the present invention, the lithographic base can be a flexible support. As flexible support in connection with the present embodiment it is particularly preferred to use a plastic film e.g. substrated polyethylene terephthalate film, polyethylene naphthalate film, cellulose acetate film, polystyrene film, polycarbonate film, polyethylene film, polypropylene film, polyvinyl chloride film, polyether sulphone film. The plastic film support may be opaque or transparent.

Still further also paper or glass of a thickness of not more than 1.2 mm can also be used.

In accordance with the present invention the imaging element is image-wise exposed. During said exposure, the exposed areas are converted to hydrophobic and oleophilic areas while the unexposed areas remain hydrophilic.

Said image-forming can be realized by direct thermal recording wherein the thermal transfer is effected by heat radiation, heat conductivity or inductive heat transport. On the heated areas the hydrophobic polymer particles coagulate and forms a hydrophobic area while on the non-heated areas the hydrophobic polymer particles remain unchanged and said area remains hydrophilic.

Said image-forming can also be effected by irradiation with high intensity light. The heat-sensitive material should then comprise a compound capable of converting light into heat.

Image-wise exposure in connection with the present invention is preferably an image-wise scanning exposure involving the use of a laser or L.E.D. Preferably used are lasers that operate in the infrared or near-infrared, i.e. wavelength range of 700–1500 nm. Most preferred are laser diodes emitting in the near-infrared.

According to the present invention the plate is then ready for printing without an additional development and can be mounted on the printing press.

According to a further method, the imaging element is first mounted on the printing cylinder of the printing press and then image-wise exposed directly on the press. Subsequent to exposure, the imaging element is ready for printing.

The printing plate of the present invention can also be used in the printing process as a seamless sleeve printing plate. In this option the printing plate is soldered in a cylindrical form by means of a laser. This cylindrical printing plate which has as diameter the diameter of the print cylinder is slid on the print cylinder instead of mounting a conventional printing plate. More details on sleeves are given in "Grafisch Nieuws", 15, 1995, page 4 to 6.

The following examples illustrate the present invention without limiting it thereto. All parts and percentages are by weight unless otherwise specified.

EXAMPLES

Comparative Example

To 446 g of an aqueous dispersion comprising 25% by weight of $TiO_2$ with average particle size between 0.3 and 0.5 μm and 2.5% by weight of polyvinylalcohol (hydrolyzed polyvinylacetate, marketed by Wacker Chemie GmbH, F. R. Germany, under the trademark POLYVIOL WX), 218 g of an aqueous dispersion of hydrolyzed tetramethoxysilane (22% by weight of hydrolyzed tetramethoxysilane) was added. To this mixture 10 g of a 4.1% by weight solution of AKYPO OP80™ was added. Akypo OP80 is a commercial available surfactant from Chemy. Also 2 g of a 5% by weight solution of a fluorosurfactant, N-polyoxyethyleneethyl-perfluorooctane acid amide was added.

The volume was adjusted to 1000 ml with distilled water. The pH was adjusted to 4.0 with NaOH.

The solution was applied to a heat-set, biaxially oriented polyethylene terephtalate film with a thickness of 1751 μm, so that a total thickness of 6.83 g/m$^2$ of the coating was present. The coating was applied at a wet thickness of 50 μm and the film was dried under impingement drying with air from 50° C. and a moisture content of 4 g/m$^3$.

Example 1

To 348 g of an aqueous dispersion comprising 25% by weight of TiO2 with an average particle size between 0.3 and 0.5 μm and 2.5% by weight of polyvinylalcohol (hydrolyzed polyvinylacetate, marketed by Wacker Chemie GmbH, F. R. Germany, under the trademark POLYVIOL WX), 170 g of an aqueous dispersion of hydrolyzed tetramethoxysilane (22% by weight of hydrolyzed tetramethoxysilane) was added. To this mixture 10 g of a 4.1% by weight solution of AKYPO OP80™ was added. Akypo OP80 is a commercial available surfactant from Chemy. Also 2 g of a 5% by weight solution of a fluorosurfactant, N-polyoxyethyleneethyl-perfluorooctane acid amide was added.

Then 242.5 g of a polystyrene emulsion was added. This emulsion was 12.05% by weight and non-ionically stabilized.

The volume was adjusted to 1000 ml with distilled water. The pH was adjusted to 4.0 with NaOH.

The solution was applied to a heat-set, biaxially oriented polyethylene terephtalate film with a thickness of 175 μm, so that a total thickness of 6.83 g/m$^2$ of the coating was present. The coating was applied at a wet thickness of 50 μm and the film was dried under impingement drying with air from 50° C. and a moisture content of 4 g/m$^3$.

Example 2

To 312 g of an aqueous dispersion comprising 25% by weight of $TiO_2$ with an average particle size between 0.3 and 0.5 μm and 2.5% by weight of polyvinylalcohol (hydrolyzed polyvinylacetate, marketed by Wacker Chemie GmbH, F.R. Germany, under the trademark POLYVIOL WX), 152 g of an aqueous dispersion of hydrolyzed tetramethoxysilane (22% by weight of hydrolyzed tetramethoxysilane) was added. To this mixture 10 g of a 4.1% by weight solution of AKYPO OP80™ was added. Akypo OP80 is a commercial available surfactant from Chemy. Also 2 g of a 5% by weight solution of a fluorosurfactant, N-polyoxyethyleneethyl-perfluorooctane acid amide was added.

Then 330.6 g of a polystyrene emulsion was added. This emulsion was 12.05% by weight and non-ionically stabilized. Also 2 g of an IR-dye (structure I) was added. This compound was premixed in 18 g of ethanol.

The volume was adjusted to 1000 ml with distilled water. The pH was adjusted to 4.0 with NaOH.

The solution was applied to a heat-set, biaxially oriented polyethylene terephtalate film with a thickness of 175 μm, so that a total thickness of 6.83 g/m$^2$ of the coating was present. The coating was applied with a wet thickness of 50 μm and the film was dried under impingement drying with air from 500°°C. and a moisture content of 4 g/m$^3$.

Structure I

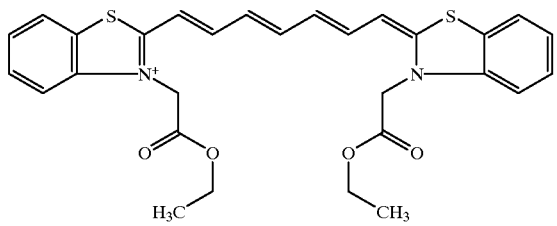

Example 3

To 332 g of an aqueous dispersion comprising 25% by weight of $TiO_2$ with an average particle size between 0.3 and 0.5 μm and 2.5% by weight of polyvinylalcohol (hydrolyzed polyvinylacetate, marketed by Wacker Chemie GmbH, F. R. Germany, under the trademark POLYVIOL WX), 79.1 g of an aqueous dispersion of hydrolyzed tetramethoxysilane (22% by weight of hydrolyzed tetramethoxysilane) was added. To this mixture 10 g of a 4.1% by weight solution of AKYPO OP80™ was added. Akypo OP80 is a commercial available surfactant from Chemy. Also 2 g of a 5% by weight solution of a fluorosurfactant, N-polyoxyethyleneethyl-perfluorooctane acid amide was added.

Then 331 g of a polystyrene emulsion was added. This emulsion was 12.05% by weight and non-ionically stabilized.

The volume was adjusted to 1000 ml with distilled water. The pH was adjusted to 4.0 with NaOH.

The solution was applied to a heat-set, biaxially oriented polyethylene terephtalate film with a thickness of 175 μm, so that a total thickness of 6.83 g/m$^2$ of the coating was present. The coating was applied at a wet thickness of 50 $\mu$m and the film was dried under impingement drying with air from 50° C. and a moisture content of 4 g/m$^3$.

Example 4

To 308 g of an aqueous dispersion comprising 25% by weight of $TiO_2$ with average particle size between 0.3 and 0.5 $\mu$m and 2.5% by weight of polyvinylalcohol (hydrolyzed polyvinylacetate, marketed by Wacker Chemie GmbH, F. R. Germany, under the trademark POLYVIOL WX), 73.5 g of an aqueous dispersion of hydrolyzed tetramethoxysilane (22% by weight of hydrolyzed tetramethoxysilane) was added. Also 175 g of a 5% by weight of a polyvinylalcohol solution was added. The used polyvinylalcohol is POLYVIOL WX 48/20, commercially available from Wacker, Burghausen, Germany. To this mixture 10 g of a 4.1% by weight solution of AKYPO OP80™ was added. Akypo OP80 is a commercially available surfactant from Chemy. Also 2 g of a 5% by weight solution of a fluorosurfactant, N-polyoxyethyleneethyl-perfluorooctane acid amide was added.

Then 331 g of a polystyrene emulsion was added. This emulsion was 12.05% by weight and non-ionically stabilized.

The volume was adjusted to 1000 ml with distilled water. The pH was adjusted to 4.0 with NaOH.

The solution was applied to a heat-set, biaxially oriented polyethylene terephtalate film with a thickness of 175 $\mu$m, so that a total thickness of 6.83 g/m$^2$ of the coating was present. The coating was applied with a wet thickness of 50 $\mu$m and the film was dried under impingement drying with air from 50° C. and a moisture content of 4 g/m$^3$.

Example 5

To 314 g of an aqueous dispersion comprising 25% by weight of $TiO_2$ with average particle size between 0.3 and 0.5 $\mu$m and 2.5% by weight of polyvinylalcohol (hydrolyzed polyvinylacetate, marketed by Wacker Chemie GmbH, F. R. Germany, under the trademark POLYVIOL WX), 74.6 g of an aqueous dispersion of hydrolyzed tetramethoxysilane (22% by weight of hydrolyzed tetramethoxysilane) and 7.4 g of glycerol was added. To this mixture 10 g of a 4.1% by weight solution of AKYPO OP80™ was added. Akypo OP80 is a commercial available surfactant from Chemy. Also 2 g of a 5% by weight solution of a fluorosurfactant, N-polyoxyethyleneethyl-perfluorooctane acid amide was added.

Then 331 g of a polystyrene emulsion was added. This emulsion was 12.05% by weight and non-ionically stabilized.

The volume was adjusted to 1000 ml with distilled water. The pH was adjusted to 4.0 with NaOH.

The solution was applied to a heat-set, biaxially oriented polyethylene terephtalate film with a thickness of 175 $\mu$m, so that a total thickness of 6.83 g/m$^2$ of the coating was present. The coating was applied with a wet thickness of 50 $\mu$m and the film was dried under impingement drying with air from 50° C. and a moisture content of 4 g/m$^3$.

Nanostructure of Heat-sensitive Imaging Element

The specific surface and the pore diameter of the coating was measured by a Micromeritics ASAP2400-apparatus.

The average surface roughness of the plate is measured with a perthometer MAHR PERTHEN S6P containing a measuring head RTK50 (tradename of Feinprüf Perthen GmbH, Goettingen, Germany) equipped with a diamond stylus with a diameter of 5 $\mu$m under a pressure of 1.0 mN.

Lithographic Properties:

Sensitivity to Staining:

The lithographic properties of the thermal imaging element was tested on a Heidelberg GTO 52 with a Van Son Rubberbase RB2329 ink and Rotamatic fountain. Before testing the lithographic properties, the press was ran during 3000 prints to obtain 'equilibrium'-conditions. Then the test plates were mounted on the press without wetting. The press was then rotated 10 times with contact from the plates with the Dahlgren dampening system. Then contact was made with the ink rollers and after 5 rotations, contact was made with paper. Staining on the printed papers was given a visual quotation.

Thermal Sensitivity:

The above mentioned materials were imaged in an OYO GS618 thermal printer, with a resolution of 400 dpi, printed under standard conditions at 0.2 inch/s.

After imaging, the plates were tested on an AB Dick 360 press, using Van Son Rubber Base ink and Tame 2% fountain solution. On the printed papers, image quality was visually evaluated. The run length was 250.

Physical Properties:

The physical properties of the imaging element were evaluated by measuring the scratch resistance. In this test, the mechanical properties and the adhesion are quantified.

Sratching the Heat-sensitive Imaging Element

The above mentioned materials were scratched in the test 'Linisoft'. This test simulates the mechanical strain in the printing process. First, the imaging element was swollen in distilled water until equilibrium occured. For safety, a time of 2 minutes was applied.

In this test scratches are formed by displacing needles at a speed of 96 cm/min, under well defined loads. The needles are of ruby type with a radius of 1.5 mm. 15 scratches are formed under following loads: 57–85–114–142–170–113–169–225–282–338–400–600–800–1000 en 1200 mN.

Evaluation of the Scratch Resistance

After ddrying the image element, the 15 scratches were controlled on width of damage given a corresponding quotation as indicated in table 1.

When the depth of the scratch was down to the support, this means the total layer was removed, then an extra value was added. This phenomenon was visible by a discoloration to transparency in the scratch region. This value was 3 when the discoloration was local. When the entire scratch was transparant, a value of 5 was added.

TABLE 1

| Quotation | Width of scratch |
|---|---|
| 0 | no scratch visible |
| 1 | scratch smaller than 50 $\mu$m |
| 2 | width between 50 and 100 $\mu$m |
| 3 | width between 100 and 150 $\mu$m |
| 4 | width between 150 and 200 $\mu$m |
| 5 | width greater than 200 $\mu$m |
| +3 | when scratch is broken white line |
| +5 | when scratch is fully white |

The sum of all given quotations resulted in the scratch resistance of the material. The lower the value, the better the scratch resistance.

| | Results: | | | | |
|---|---|---|---|---|---|
| | Ratio | MPW | Linisoft | Staining | Image quality/print length |
| Comparative | 0.339 | 3.9 | 0 | very good | not thermally sensitive |
| Ex 1 | 0.892 | 1.6 | 0 | very good | very good |
| Ex 2 | 0.775 | 4.1 | 0 | good | good |
| Ex 3 | 0.720 | 19 | 59 | bad | bad |
| Ex 4 | 0.591 | 4.0 | 29 | bad | bad |
| Ex 5 | 1.256 | 17 | 38 | bad | bad |

Ratio: Ratio of specific surface on mean roughness ($g/m^2 \cdot \mu m$)
MPW: mean pore width (nm).

From the results it is clear that the ratio of specific surface over mean roughness should be higher than 0.65 and the mean pore width should be less than 15 nm of a heat-sensitive material in order to obtain a lithographic plate with a good scratch resistance and no or almost no staining.

What is claimed is:

1. A heat-sensitive material for making lithographic printing plates comprising on a lithographic support an image-forming layer comprising a hydrophilic binder, a cross-linking agent for said hydrophilic binder, metal oxide particles with a mean diameter of at least 100 nm and dispersed hydrophobic thermoplastic polymer particles, characterized in that said image-forming layer has a ratio of specific surface (in $m^2$ per g) over mean roughness (in $\mu m$) of more than 0.65 and has a mean pore width of less than 15 nm.

2. A heat-sensitive material according to claim 1 wherein said ratio of specific surface over mean roughness is more than 0.85.

3. A heat-sensitive material according to claim 1 wherein said mean pore width is less than 7 nm.

4. A heat-sensitive material according to claim 1 wherein said metal oxide particle is titanium dioxide.

5. A heat-sensitive material according to claim 1 wherein said heat-sensitive material comprises a compound capable of converting light into heat.

6. A heat-sensitive material according to claim 5 wherein said compound capable of converting light into heat is an IR sensitive dye or pigment.

7. A heat-sensitive material according to claim 1 wherein said image forming layer is present in an amount ranging from 1 to 12 $g/m^2$.

8. A method for making a lithographic printing plate comprising the step of image-wise exposing to heat a heat-sensitive material according to claim 1 thereby resulting in an increase in hydrophilicity and oleophilicity of the exposed areas without loss of hydrophilicity non-imaged parts.

9. A method for making lithographic printing plate according to claim 8 wherein an image is formed by direct thermal recording.

10. A method for making lithographic printing plates according to claim 8 wherein the heat-sensitive material is mounted on a printing press.

* * * * *